US009932785B2

(12) United States Patent
Frith et al.

(10) Patent No.: US 9,932,785 B2
(45) Date of Patent: Apr. 3, 2018

(54) SYSTEM, APPARATUS, AND METHOD FOR DUAL-ACTIVITY DRILLING

(71) Applicant: Frank's International, LLC, Houston, TX (US)

(72) Inventors: Benjamin Frith, Lafayette, LA (US); Neil Alleman, Scott, LA (US); Robert L. Thibodeaux, Lafayette, LA (US); Jeremy R. Angelle, Youngsville, LA (US)

(73) Assignee: FRANK'S INTERNATIONAL, LLC, Houston, TX (US)

( * ) Notice: Subject to any disclaimer, the term of this patent is extended or adjusted under 35 U.S.C. 154(b) by 615 days.

(21) Appl. No.: 14/556,475

(22) Filed: Dec. 1, 2014

(65) Prior Publication Data

US 2016/0153251 A1 Jun. 2, 2016

(51) Int. Cl.

| | |
|---|---|
| ***E21B 7/12*** | (2006.01) |
| ***E21B 19/16*** | (2006.01) |
| ***E21B 19/24*** | (2006.01) |

(52) U.S. Cl.

CPC ..... *E21B 19/16* (2013.01); *E21B 7/12* (2013.01); *E21B 19/24* (2013.01)

(58) Field of Classification Search

CPC ..... E21B 7/12; E21B 19/002; E21B 19/16; E21B 19/24

See application file for complete search history.

(56) References Cited

U.S. PATENT DOCUMENTS 2,999,549 A * 9/1961 Stratton ..... E21B 7/128 175/5
3,475,038 A * 10/1969 Matherne ..... E21B 19/24 285/27
4,273,372 A * 6/1981 Sheshtawy ..... E21B 17/06 166/212

(Continued)

FOREIGN PATENT DOCUMENTS

WO 2011061532 A1 5/2011

OTHER PUBLICATIONS

International Search Report and Written Opinion dated Nov. 26, 2015, PCT Application No. PCT/US2015/055202, filed Oct. 13, 2015, pp. 1-10.

(Continued)

*Primary Examiner* — Matthew R Buck
(74) *Attorney, Agent, or Firm* — MH2 Technology Law Group LLP

(57) ABSTRACT

Methods and apparatus for running a tubular into a wellbore. The method includes attaching a first member of a lifting coupling to a first tubular, and attaching a second member of the lifting coupling to a second tubular. The second tubular extends downward through an opening of a rotary station. The method also includes connecting together the first and second members of the lifting coupling, such that a weight of the second tubular is transmitted via the lifting coupling to the first tubular. The method further includes lowering the lifting coupling, the second tubular, and at least a portion of the first tubular through the opening, and disconnecting the second member from the first member. The method additionally includes moving the second member of the lifting coupling and the second tubular laterally, away from the opening.

22 Claims, 5 Drawing Sheets

(56) References Cited

U.S. PATENT DOCUMENTS

| | | | | |
|---|---|---|---|---|
| 4,293,146 | A | 10/1981 | Beynet et al. | |
| 4,442,907 | A * | 4/1984 | Sexton | E21B 3/02 166/85.1 |
| 4,943,188 | A | 7/1990 | Peppel | |
| 5,052,849 | A * | 10/1991 | Zwart | E21B 17/02 403/20 |
| 6,056,071 | A | 5/2000 | Scott et al. | |
| 6,085,851 | A | 7/2000 | Scott et al. | |
| 6,766,860 | B2 | 7/2004 | Archibald et al. | |
| 7,628,225 | B2 * | 12/2009 | Petersson | E21B 15/02 166/341 |
| 8,387,704 | B2 * | 3/2013 | Rodrigues | B63B 35/4413 166/352 |
| 8,678,094 | B2 | 3/2014 | Banks | |
| 9,399,891 | B2 * | 7/2016 | Ahn | E21B 33/064 |
| 9,523,252 | B2 * | 12/2016 | White | E21B 23/00 |
| 2004/0020692 | A1 * | 2/2004 | McAllister | E21B 19/16 175/171 |
| 2006/0249292 | A1 | 11/2006 | Guidry | |
| 2007/0251700 | A1 | 11/2007 | Mason et al. | |
| 2009/0008081 | A1 | 1/2009 | Bouligny | |
| 2010/0213706 | A1 * | 8/2010 | Buytaert | E21B 17/04 285/361 |
| 2011/0017511 | A1 | 1/2011 | Payne | |
| 2014/0332487 | A1 * | 11/2014 | Boutwell, Jr. | B66C 19/00 212/199 |
| 2016/0024852 | A1 * | 1/2016 | Kannegaard | E21B 15/02 175/5 |

OTHER PUBLICATIONS

Dick Ghiselin, "Rigs drilling on the double", E&P, http://www.epmag.com/EP-Magazine/archive/Rigs-drilling-the-double_3702?ch=more-title, accessed Oct. 9, 2014, pp. 1-4.

* cited by examiner

SYSTEM, APPARATUS, AND METHOD FOR DUAL-ACTIVITY DRILLING

BACKGROUND

In offshore drilling applications, oilfield tubulars (e.g., casing, drill pipe, strings thereof, etc.) are run from a drilling rig located on a marine vessel or a platform, down to the ocean floor, and then into an earthen bore formed in the ocean floor. In deep-water situations, the time required to run the oilfield tubulars from the drilling rig at the ocean surface to the ocean floor may be significant. Further, drilling equipment, rigs, and drilling services may incur time-based charges during drilling operations, which may be on the order of hundreds of thousands of dollars, or more, per day. Accordingly, such drilling time is at a premium.

One way to conserve time is to run the oilfield tubulars at least partially to the ocean floor during "offline" time. This may be accomplished in a process known as "dual-activity drilling," whereby casing is run down to, or at least toward, the ocean floor during drilling operations. One way to conduct dual-activity drilling is to use two rotary stations: one primary and one auxiliary. While drilling is being performed in the primary rotary station, the casing string may be run at least partially down to the ocean floor using the auxiliary rotary station. Once deployed to a desired depth, the casing string may be "hung-off" of the drilling rig, i.e., landed in a mobile cart disposed below the auxiliary rotary station, typically in a moonpool. At a desired depth, the drilling operations being performed in the primary rotary station may be stopped, the drill string may be removed, and then the partially-deployed casing string may be moved, e.g., via the cart, to the primary rotary station. The casing string may then be "picked-up" through the primary rotary station, and then deployed into the well using standard casing running equipment.

Typically, such hang-off and pickup operations rely on a "soft-break" process. In the soft-break process, a drill pipe is connected ("made up") to the top end of the partially-deployed casing string. Although equipment may be available at the rotary station to make this connection at a high torque (e.g., 70,000 ft-lbs or more), a significantly lower torque (e.g., less than the standard, required makeup torque of the connection) is applied to establish connection. The casing string, supported by the stand of drill pipe, is then lowered to the cart, and the weight of the casing string is transferred to the cart.

The drill pipe, which provided the connection to the lifting mechanism used to lower the casing string, is then disconnected ("broken out") from the casing string to allow the casing string to be moved. Such disconnection may be accomplished using torque available from a top drive, which may be adequate to break-out the lower-torque connection, but would be insufficient to break-out a fully-torqued connection. The cart then moves the casing string into position below the primary rotary station, the drill pipe is again made up to the casing string by another lower-torque connection, e.g., as provided by the top drive, and then casing string is hoisted up through the primary rotary station. Once located at the primary rotary station, any suitable casing running equipment may be employed to run the casing string into the borehole.

In some instances, however, applying less than optimal torque to the connection between the drill pipe and the casing string may result in a connection with compromised strength. If the casing string backs-out or otherwise becomes disconnected during hang-off or pickup, e.g., by failure of such a weakened connection, the casing string may fall to the ocean floor, which may result in a loss of the casing string.

Thus, there is a need for dual-activity capability drilling systems and methods, and apparatus that support the same, which provide or employ secure connections for hang-off and pickup.

SUMMARY

Embodiments of the disclosure may provide a method for running a tubular into a wellbore. The method includes attaching a first member of a lifting coupling to a first tubular, and attaching a second member of the lifting coupling to a second tubular. The second tubular extends downward through an opening of a rotary station. The method also includes connecting together the first and second members of the lifting coupling, such that a weight of the second tubular is transmitted via the lifting coupling to the first tubular. The method further includes lowering the lifting coupling, the second tubular, and at least a portion of the first tubular through the opening, and disconnecting the second member from the first member, after lowering the lifting coupling, the second tubular, and the at least a portion of the first tubular. The method additionally includes moving the second member of the lifting coupling and the second tubular laterally, away from the opening.

Embodiments of the disclosure may also provide a drilling system. The drilling system includes a first level including a rotary station. The rotary station is configured to run a tubular string into a wellbore. The drilling system also includes a second level that is vertically below the first level. The second level includes a cart configured to support a tubular string and move between a first position located below the rotary station and a second position that is not located below the rotary station. The drilling system also includes a lifting coupling including a first member configured to be connected with a first tubular, with the first tubular at least a portion of a landing string or drill pipe. The lifting coupling also includes a second member configured to be connected with a second tubular, with the second tubular including a portion of a landing string and casing. The first member includes a plurality of engaging features, and the second member includes a plurality of engaging features that are configured to engage the plurality of engaging features of the first member such that the first member and the second member are configured to be coupled together and decoupled from one another substantially without transmitting a torque between the first and second tubulars.

Embodiments of the disclosure may also provide an apparatus for a drilling process. The apparatus includes a first member configured to be coupled with a first tubular, the first member including an engaging portion and a plurality of hooks defined at the engaging portion. The apparatus also includes a second member configured to be coupled with a second tubular. The second member includes a receiving portion defining a receiving cavity and including a plurality of lugs that extend into the receiving cavity. The receiving cavity is sized to at least partially receive the engaging portion of the first member. The plurality of lugs are configured to engage the plurality of hooks, such that the second member is able to transmit a weight of the second tubular to the first member via the plurality of hooks.

It is to be understood that both the foregoing general description and the following detailed description are exemplary and explanatory only and are not restrictive of the present teachings, as claimed.

BRIEF DESCRIPTION OF THE DRAWINGS

The accompanying drawing, which is incorporated in and constitutes a part of this specification, illustrates an embodiment of the present teachings and together with the description, serves to explain the principles of the present teachings. In the figures.

Figure 1:
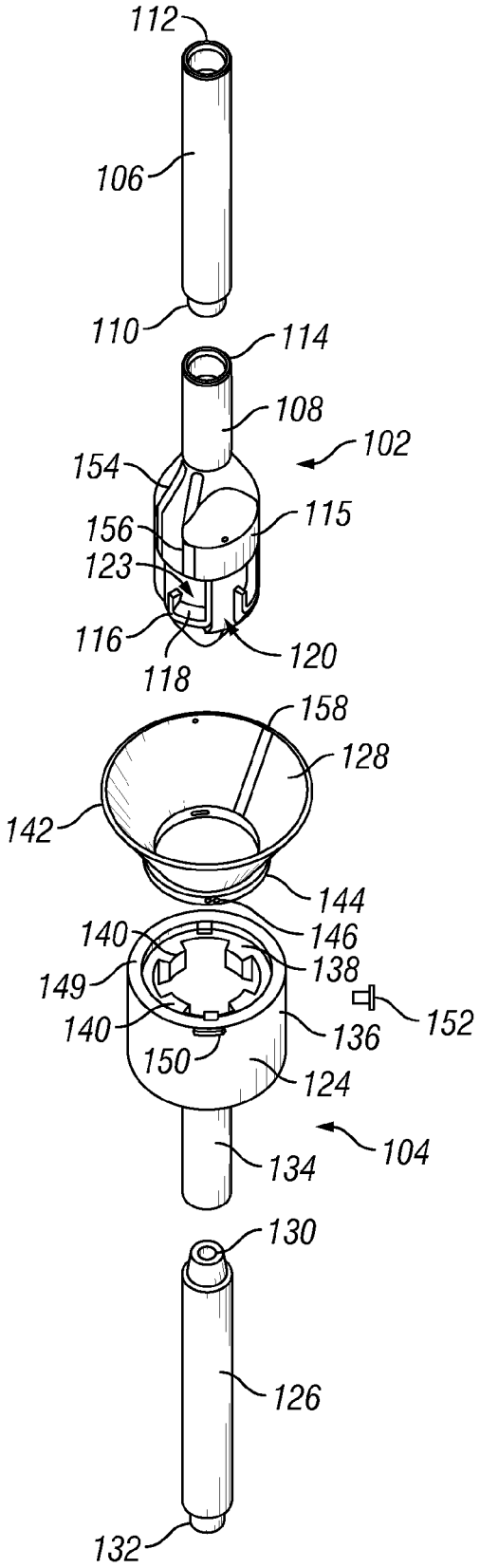
FIG. 1 illustrates an exploded, perspective view of a lifting coupling, according to an embodiment.

It should be noted that some details of the figure have been simplified and are drawn to facilitate understanding of the embodiments rather than to maintain strict structural accuracy, detail, and scale.

DETAILED DESCRIPTION

Reference will now be made in detail to embodiments of the present teachings, examples of which are illustrated in the accompanying drawing. In the drawings, like reference numerals have been used throughout to designate identical elements, where convenient. In the following description, reference is made to the accompanying drawing that forms a part thereof, and in which is shown by way of illustration a specific exemplary embodiment in which the present teachings may be practiced. The following description is, therefore, merely exemplary.

The numerical ranges and parameters setting forth the broad scope of the disclosure are approximations. Any numerical value, however, inherently contains certain errors necessarily resulting from the standard deviation found in their respective testing measurements. Moreover, all ranges disclosed herein are to be understood to encompass any and all sub-ranges subsumed therein.

Further, as the term is used herein, "attach" (and grammatical equivalents thereof) is defined broadly to include any type of physical connectivity between two structures. This includes coupling two parts directly together via threading, welding, fastening, brazing, etc., or coupling two parts together via one or more intermediary structures disposed between the two attached parts. Moreover, two structures may be "attached" while allowing for relative movement therebetween. Further, the terms "bottom" and "top" are used herein to refer to the relative positioning of elements in the figures, but are not meant to limit the disclosed embodiments to a particular orientation in space, unless otherwise expressly stated herein.

Figure 2:
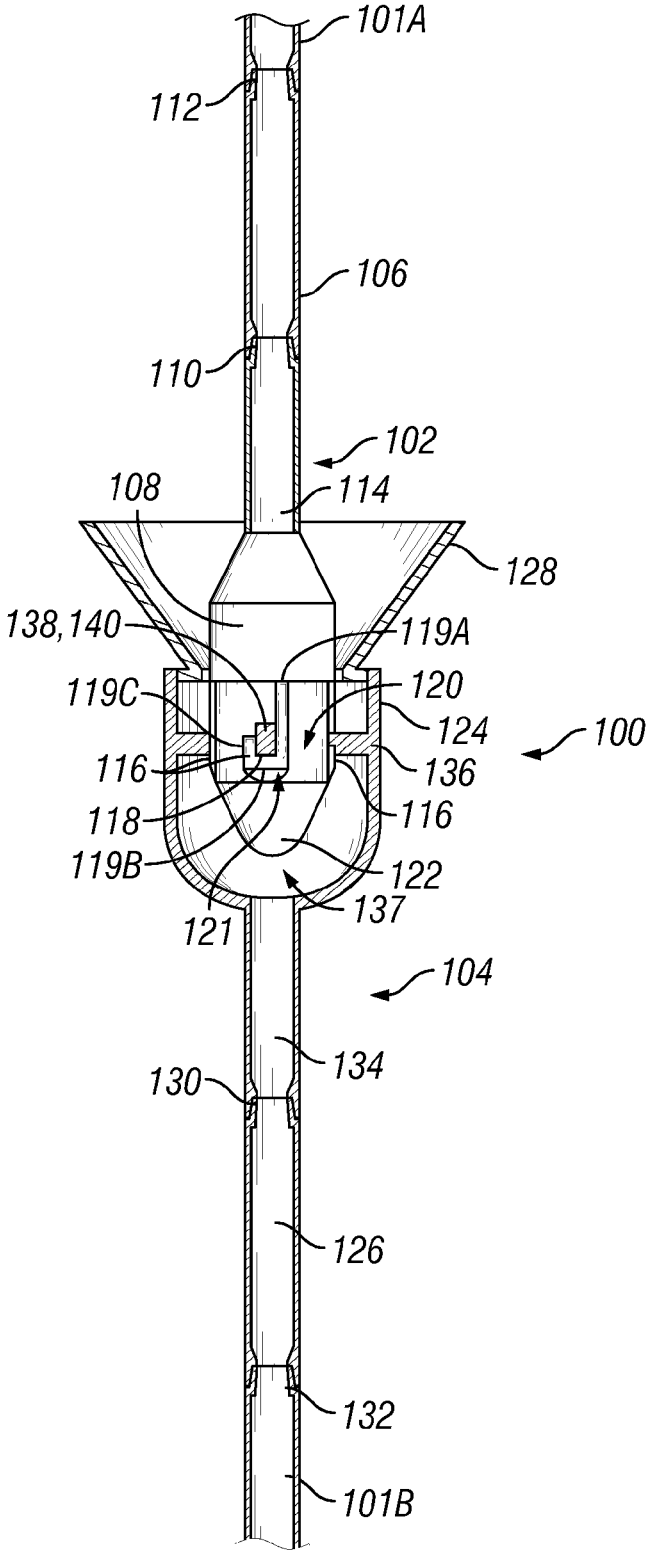
FIG. 2 illustrates a side, conceptual view of the lifting coupling connected to a first tubular and a second tubular, according to an embodiment.

FIG. 1 illustrates an exploded, perspective view of a lifting coupling 100, according to an embodiment. FIG. 2 illustrates a side, conceptual view of the lifting coupling 100, with a portion of the lifting coupling 100 illustrated as transparent and/or in cross-section, for purposes of describing the connection formed therein, according to an embodiment. As shown in FIG. 2, the lifting coupling 100 may be connected to a first tubular 101A and a second tubular 101B, respectively, according to an embodiment. It will be appreciated that the illustrated lifting coupling 100 is merely one example of a lifting coupling that may be employed consistent with the disclosed systems and methods.

Further, in at least some embodiments, the lifting coupling 100 may be configured for use in dual-activity capability drilling systems, e.g., in offshore applications. In such applications, a casing string (e.g., the second tubular 101B), or any other type of tubular, may be transferred between two rotary stations. The lifting coupling 100 may facilitate the establishment of a reliable connection between a stand of one or more joints of drill pipe (e.g., the first tubular 101A) used to lower and hoist the second tubular 101B, and may substantially avoid a transmission of a torque force between the two (or more) parts of the lifting coupling 100 as it is connected together, as will be described in greater detail below. As the term is used herein, "substantially avoid a transmission of torque" means that, although some amount of incidental torque may be transmitted, generally, the connection formed does not rely on the transmission of torque between two relatively rotatable parts.

Referring to the specific, illustrated embodiment, the lifting coupling 100 may generally include a first member 102 and a second member 104. The first and second members 102, 104 may each include several parts, and may thus also be considered assemblies or subassemblies, with the term "member" not being considered to limit the number of parts that may be included in each.

The first member 102 may include an extension tubular or "sub" 106 and a first connector 108. The extension sub 106 may have a pin end 110 and a box end 112. The box end 112 may be connectable to the first tubular 101A. The pin end 110 may be connectable to a tubular portion 114 of the first connector 108. In some embodiments, the first member 102 may omit the extension sub 106, e.g., by elongating the tubular portion 114 of the first connector 108.

The first connector 108 may include an engaging portion 115, which may extend axially from and radially outward from the tubular portion 114. The engaging portion 115 may include one or more first engaging features 116 disposed thereon, therein, or otherwise included therewith. In the illustrated embodiment, the first engaging features 116 are formed as hooks 118, with slots 120 formed between the hooks 118. In an embodiment, the slots 120 may be cut from the engaging portion 115 so as to define the hooks 118 therebetween. Accordingly, in at least one embodiment, the slots 120 may be generally J-shaped, and thus may be referred to herein as "J-slots" 120. Furthermore, the slots 120 may include an open end 121, e.g., facing axially away from the tubular portion 114.

In other embodiments, the first engaging features 116 may include bails, pins, lugs, etc. in lieu of or in addition to such hooks 118 and slots 120, and thus it will be appreciated that the illustrated embodiment is merely one example among many contemplated. In the specific, illustrated embodiment, four hooks 118 are positioned generally equi-angularly around the engaging portion 115 of the first member 102. However, any number of engaging features 116 may be employed and may be spaced uniformly or unequally apart from one another. In an embodiment, each hook 118 may include an axially-elongated wall 119A, a circumferentially-extending wall 119B, and a lip portion 119C. This configuration may provide a pocket 123 defined by each hook 118 in which engaging features (e.g., lugs) of the second member 104 may be securely retained, as will be described in greater detail below.

The first connector 108 may also include a first stabbing guide portion 122, which may extend axially from the engaging portion 115, such that the engaging portion 115 is located intermediate of the stabbing guide portion 122 and the tubular portion 114. In an embodiment, the stabbing guide portion 122 may form a generally cone-shaped geometry, which may assist in receiving the first connector 108 at least partially into the second member 104, as will be described in greater detail below. In some embodiments, the tubular portion 114, engaging portion 115, and the stabbing guide portion 122 may be integrally formed, but in other embodiments, may be formed from two or more components that are coupled together.

Turning now to the second member 104, the second member 104 may include a second connector 124, an extension tubular or "sub" 126, and a stabbing guide 128. The extension tubular 126 may include a first pin end 130 and a second pin end 132. The second pin end 132 may be configured to be connected with a box end of the second tubular 101B, which may be deployed downwards, toward the ocean floor and/or into a wellbore. The first pin end 130 may be connected with a tubular portion 134 of the second connector 124. It will be appreciated that an embodiment in which the first end 130 is a pin end is merely an example and not to be considered limiting. Further, in some embodiments, the extension sub 126 may be omitted, and the tubular portion 134 of the second connector 124 may be connected directly to the second tubular 101B (e.g., by elongating the tubular portion 134).

The second connector 124 may include a receiving portion 136, which may be sized and configured to receive at least a portion of the engaging portion 115 therein. In other words, for example, the second connector 124 may provide a female connection for the male connection of the first connector 108. However, this is merely an example; in other examples, the first connector 108 may be configured to provide the female connection, while the second connector 124 provides the male connection.

In the illustrated embodiment, the receiving portion 136 extends axially from the tubular portion 134 and radially outwards therefrom. Further, the receiving portion 136 defines a receiving cavity 137 therein, which may be sized at least as large in diameter as the engaging portion 115, so as to receive at least a portion of the engaging portion 115 therein. The receiving portion 136 may also include one or more second engaging features 138, which may be configured to engage the first engaging features 116, e.g., without substantial torque transmission therebetween.

In an embodiment, the second engaging features 138 may include lugs 140 extending radially inward in the receiving portion 136 and into the receiving cavity 137. The number of lugs 140 may match the number of hooks 118 and slots 120, so as to be engageable therewith. However, in other embodiments, any number of lugs 140 may be employed, whether matching the number of hooks 118 and/or slots 120 or not.

The stabbing guide 128 may generally be formed as a truncated cone (i.e., frustoconical), similar to a funnel. In particular, the stabbing guide 128 may taper radially inwards from a rim 142 to a base 144 (FIG. 1). The base 144 may include one or more key slots 146, which may align with one or more key slots 150 formed in the second connector 124, e.g., proximal to an axial end 149 of the receiving portion 136. The second member 104 may also include one or more keys 152 (one is shown for purposes of illustration), which may be receivable through one of each of the key slots 146, 150, so as to retain the stabbing guide 128 in place. In other embodiments, the stabbing guide 128 may be coupled with the second connector 124 in any other way (e.g., welding, bolting, etc.) and/or may be integrally formed therewith.

In operation of the illustrated embodiment of the lifting coupling 100, the first member 102 may be coupled with the first tubular 101A, such as a stand of one or more joints of drill pipe. In particular, the box end 112 of the extension tubular 106 may be made up with the pin end of such first tubular 101A. The first tubular 101A may be employed as an extension, which allows for lowering of a landing string below the rotary station, as will be explained in greater detail below.

The second member 104 may be made up to the second tubular 101B. For example, the pin end 132 of the extension sub 126 may be made up to the box end of the last (i.e., top-most) joint of the second tubular 101B, which may be supported at a rotary station. A variety of different types of rotary stations are known and may be operated to support a string of tubulars, make up subsequent stands of tubulars to the string, and then deploy the string into the wellbore. Such systems may include casing and/or drill-pipe handling equipment (e.g., elevators, hoists, etc.), iron roughnecks, kellys, top drives, rotary tables, etc. Furthermore, the rotary stations may include an opening, such as a rotary opening, e.g., with a movable bushing disposed therein for supporting a tubular string. Accordingly, the second connector 124, e.g., coupled with the stabbing guide 128, may initially be positioned at the top end of the second tubular 101B while being supported at the rotary station, and the first member 102 may be positioned at a bottom end of the first tubular 101A, e.g., a stand of drill pipe.

The first tubular 101A may then be hoisted and moved into position above the second tubular 101B, and then lowered. This may cause the first member 102 to move in a first axial direction (e.g., downward), such that the stabbing guide portion 122 of the first connector 108 is received through the stabbing guide 128 and toward the second connector 124.

The engaging features 116, 138 may be aligned during such lowering. This may allow the first connector 108 to be at least partially received into the second connector 124 (although, again, it is emphasized that this configuration may be reversed, and the first member 102 may provide the female connection). For example, the lugs 140 may be angularly aligned with the slots 120, such that the lugs 140 are received therein when the first connector 108 is received into the second connector 124. Marks, such as painted lines 154, 156, 158 on the engaging portion 115 and on the stabbing guide 128 (and/or on the second connector 124) may provide a visual indication of when the engaging features 116, 138 are aligned, and when they are misaligned or engaged with one another. For example, when the marks 154 and 158 are aligned, the lugs 140 may be aligned with the open ends 121 of the J-slots 120, and when the first member 102 is rotated such that the marks 156 and 158 are aligned, the lugs 140 may be aligned with the pockets 123.

In the illustrated embodiment, the first connector 108 and the first tubular 101A may then be rotated, relative to the second connector 124. This may cause the lugs 140 to be received circumferentially into the J-slots 120, e.g., toward the axially-extending wall 119A and into alignment with the pockets 123. The first member 102 may then be moved in a second axial direction (e.g., raised) relative to the second member 104, such that the lugs 140 engage the circumferentially-extending wall 119B in the pocket 123. The lugs 140 may transmit an axially-directed force onto the hooks 118, and vice versa, which may result in a weight-transmitting connection. Further, such relative rotation in establishing the weight-transmitting connection may not, at least substantially, transmit torque from the first connector 108 to the second connector 124, as the rotation may be stopped when the lugs 140 contact the axially-extending wall 119A.

With the engaging features 116, 138 engaging one another, the lifting coupling 100 may provide a connection between the second tubular 101B (e.g., a portion of landing string and at least a portion of casing) and the first tubular 101A (e.g., landing string and/or drill pipe). Suitable tubular lifting devices may then be employed to lower the first tubular 101A, the second tubular 101B, and the lifting coupling downward, until the second tubular 101B (e.g., the top-most box end thereof) may be engaged and supported by a cart in a moonpool, or any other structure. The engaging features 116, 138 may then be disengaged, e.g., by moving the first member 102 down into the second member 104, and then rotating the first member 102 relative to the second member 104. The first member 102 may then be lifted away from the second member 104.

Subsequently, the first tubular 101A and the first member 102 may be again lowered toward the second member 104, still connected to the second tubular 101B, and the engaging features 116, 138 may again be meshed together. The first tubular 101A, lifting coupling 100, and the second tubular 101B may then be raised, e.g., through an opening of another rotary station as part of a "pickup" operation. The second tubular 101B may then be supported in the opening of this second rotary station, the engaging features 116, 138 disengaged, and the second member 104 disconnected from the second tubular 101B.

Figure 3:
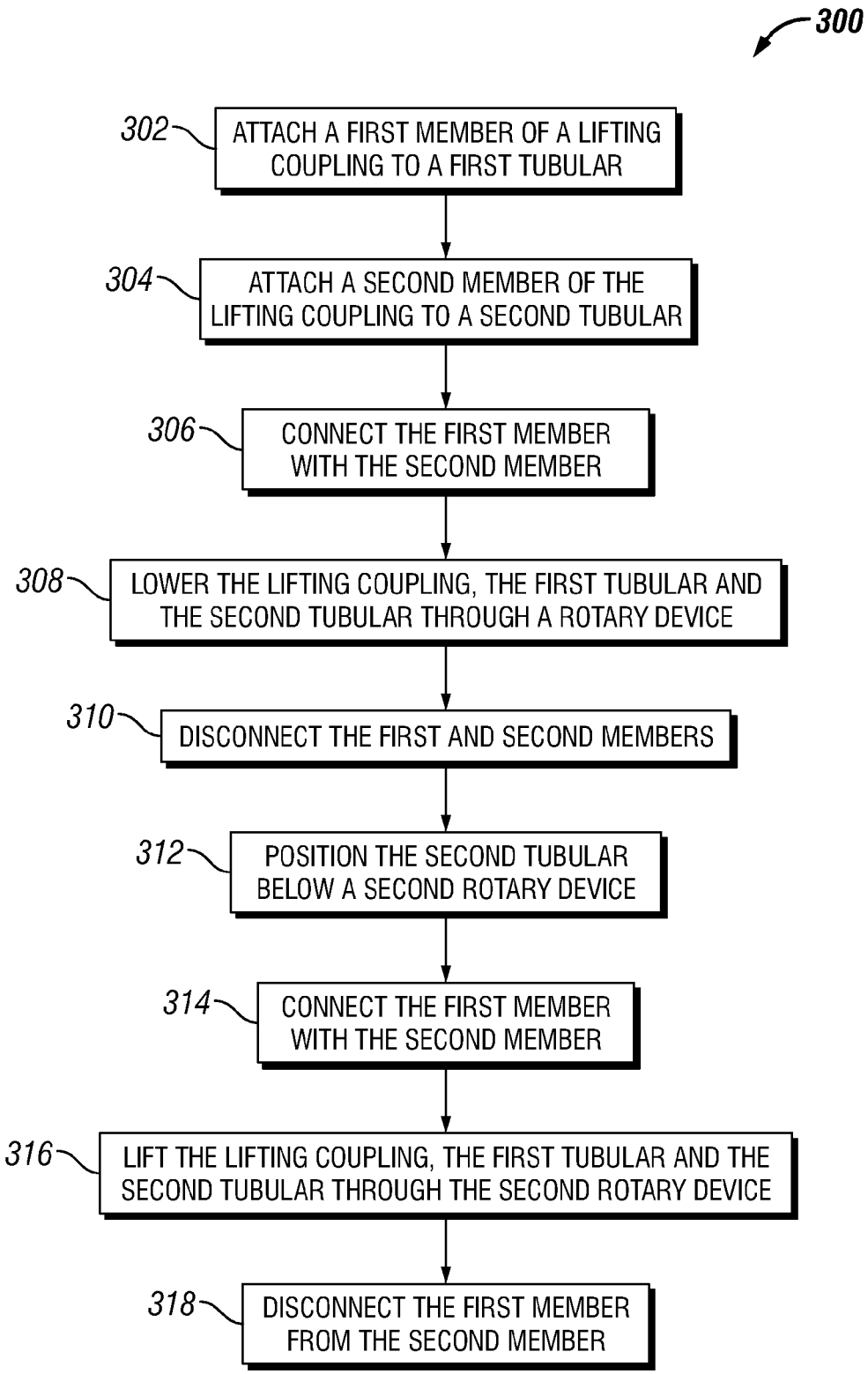
FIG. 3 illustrates a flowchart of a method for running a tubular into a wellbore, according to an embodiment.

FIG. 3 illustrates a flowchart of a method 300 for running a tubular into a wellbore, according to an embodiment. The method 300 may employ one or more embodiments of the lifting coupling 100 described above, but, in other embodiments, may employ other structures instead of the lifting coupling 100. Accordingly, it will be appreciated that at least some embodiments of the method 300 are not limited to any particular structure, unless otherwise specified herein.

Figure 4:
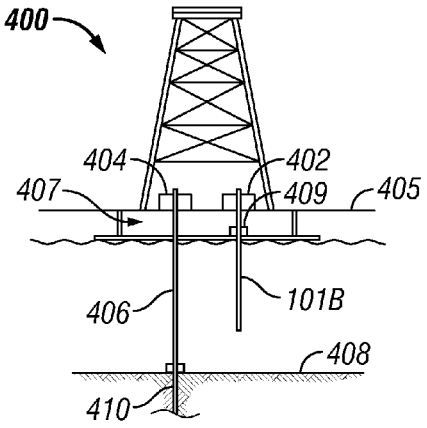
FIGS. 4-11 illustrate conceptual views of a drilling rig that employs the lifting coupling, at different stages of the method of FIG. 3, according to an embodiment.

FIG. 4 illustrates a greatly-simplified, schematic view of an initial stage of the method 300, according to an embodiment. As shown, a drilling system 400, e.g., an offshore drilling rig such as a drilling vessel, platform, etc., may include one or more rotary stations (two are shown: 402, 404). The rotary stations 402, 404 may be offset from one another and positioned on a first level 405, which may be a deck of the drilling system 400. The rotary stations 402, 404 may include drilling and/or casing running equipment, suitable for drilling a wellbore 410 in the ocean floor 408 and/or otherwise running or deploying tubulars therein. Further, the rotary stations 402, 404 may each include an opening, which may allow for tubulars to be run downwards from the system 400 and at least toward the ocean floor 408. In a specific embodiment, however, the drilling system 400 may not be configured to drill and/or otherwise run tubulars into the wellbore 410 via the first rotary station 402 (e.g., the first rotary station 402 may lack one or more components used to drill or otherwise run tubulars into a wellbore), with the second rotary station 404 providing this functionality. Accordingly, in some embodiments, the first rotary station 402 may be an "auxiliary" rotary station, while the second rotary station 404 may be a "primary" rotary station. However, in other embodiments, the auxiliary rotary station may be omitted, and the operations described herein performed using a single rotary station, such that the first rotary station may be considered the primary rotary station.

Below the first level 405, the system 400 may include a second level 407, which may be a moonpool, in which a cart 409 may be positioned. As the term is used herein, "cart" is to be broadly interpreted as any structure capable of supporting a string of tubulars and moving the string laterally with respect to deck 405. The cart 409 may include a tubular-gripping device, such as an elevator, or another tubular-supporting device, such as a bushing. The tubular-supporting device of the cart may allow tubulars to move therethrough until the tubular-supporting device is actuated, either manually or automatically. Once actuated, the weight of the tubular may be supported by the tubular-supporting device and the cart 409. Further, the cart 409 may be movable between a first position, below the primary rotary station 404, and a second position, which may be laterally offset from the primary rotary station 404. In embodiments including both the first and second rotary stations 402, 404, the second position may be below the second rotary station 404. However, at least in embodiments including a single, primary rotary station 404, the second position may be any position that is not under the primary rotary station 404. For example, the second position may be off to the side of the rotary station 404.

Referring again specifically to the illustrated embodiment, at this stage, a drill pipe 406 may extend through the second (e.g., primary) rotary station 404, toward (e.g., to) a floor 408 of the ocean, and may extend into a wellbore 410 formed therein, with drilling equipment on the drilling system 400 being employed to rotate the drill pipe 406, deploy drilling mud, etc., so as to drill the wellbore 410. During such drilling operations, the second tubular 101B (a landing string and casing) may be deployed downward through the first rotary station 402, below the system 400, at least partially to the floor 408. In some cases, the drill pipe 406 may not, initially, be deployed.

Returning to FIG. 3, the method 300 may begin by attaching the first member 102 of the lifting coupling 100 to the first tubular 101A, as at 302. As noted above, the first tubular 101A may be a stand of one or more tubulars, such as drill pipe. The first member 102 may be connected thereto, and the first tubular 101A may then be racked back on a rack stand of the drilling system 400.

Figure 5:
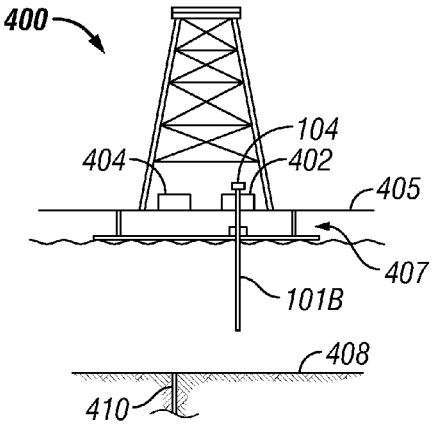

The method 300 may also include attaching the second member 104 of the lifting coupling 100 to the second tubular 101B, as at 304. FIG. 5 illustrates this stage of the method 300, according to an embodiment. The second tubular 101B may be or be part of a landing string and casing, and may thus be received through and supported by the first rotary station 402. In an example, the second member 104 may be attached to the second tubular 101B such that a high-torque connection (e.g., between about 50,000 and about 100,000 ft-lbs, or about 70,000 ft-lbs) is established therebetween. Further, as shown, the drill pipe 406 may be removed from the second rotary station 404, but in other embodiments, may remain present until a later stage of the method 300 but, e.g., prior to positioning the second tubular 101B under the second rotary station 404, as described below.

Figure 6:
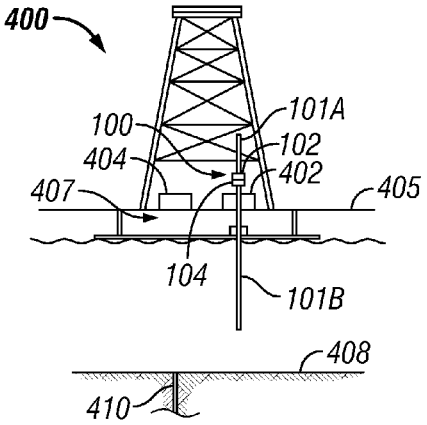

The method 300 may also include connecting the first member 102 of the lifting coupling 100 with the second member 104, while the second tubular 101B extends through the first rotary station 402, as at 306. As shown in FIG. 6, the first tubular 101A may extend from the second tubular 101B, with the first member 102 and the second member 104 coupling the two tubulars 101A, 101B together.

Figure 7:
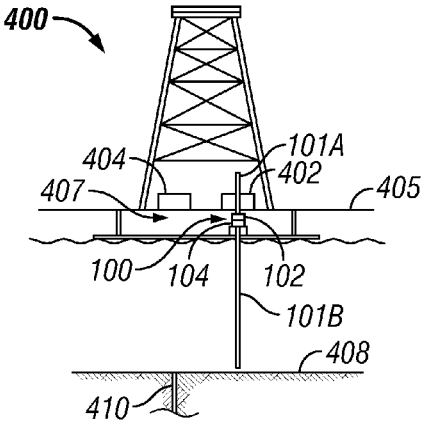

Hoisting equipment may then be attached to the first tubular 101A so as to lower the first tubular 101A, the lifting coupling 100, and the second tubular 101B at least partially through the opening of the first rotary station 402, as at 308, and into the second level 407. After the tubulars 101A, 101B and the lifting coupling 100 are lowered, as shown in FIG. 7, the second tubular 101B may be landed on or otherwise supported by an elevator supported by the cart 409, with the lifting coupling 100 being disposed in the second level 407.

Figure 8:
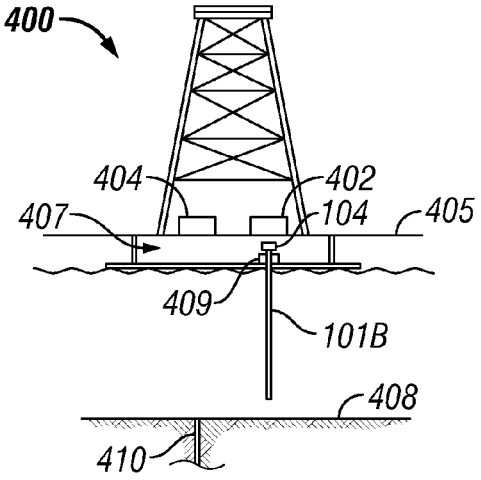

The method 300 may then proceed to disconnecting the first member 102 from the second member 104, as at 310, e.g., after lowering the lifting coupling 100, the first tubular 101A, and the second tubular 101B at least partially through the opening of the first rotary station 402. In an embodiment, once the second tubular 101B is landed on the elevator of the cart 409, the first member 102 may be lowered with respect to the second member 104 and rotated relative thereto, so as to break the connection therebetween, e.g., substantially without transmitting torque onto the second tubular 101B. In other embodiments, connecting and/or disconnecting the first member 102 and the second member 104 may not include relative rotation of one relative to the other. Once the first member 102 is disconnected from the second member 104, the first member 102 and the first tubular 101A may be removed, e.g., taken out of the second level 407. This stage is illustrated, according to an embodiment, in FIG. 8.

Figure 9:
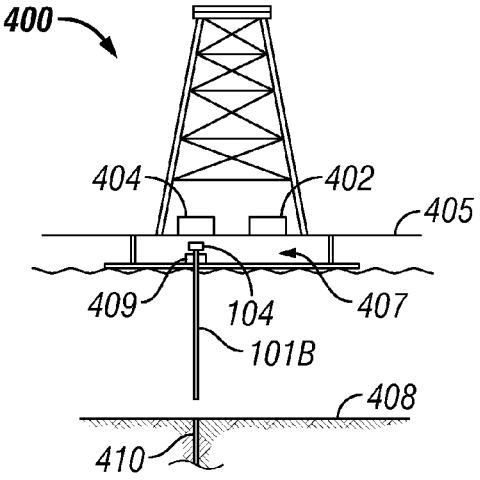

The method 300 may then proceed to positioning the second member 104 of the lifting coupling 100 and the second tubular 101B below the second (primary) rotary station 404, as at 312. This stage is illustrated, according to an embodiment, in FIG. 9. Positioning at 312 may be accomplished, for example, by moving the cart 409 in the second level 407. For example, the drilling system 400 may be moved, relative to the ocean floor 408, while the second tubular 101B remains generally stationary relative to the ocean floor 408. In another embodiment, the cart 409, and thus the second tubular 101B, may be moved relative to the ocean floor 408, while the drilling system 400 remains generally stationary. In either of these examples, the cart 409 may be positioned below the second rotary station 404, while supporting the second tubular 101B.

Figure 10:
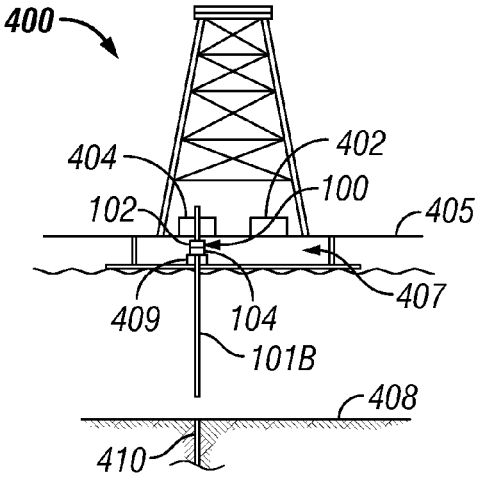

The method 300 may also include connecting together the first and second members 102, 104 of the lifting coupling 100, after positioning the second tubular 101B below the second rotary station 404, as at 314. This stage may be illustrated in FIG. 10. For example, the first tubular 101A, with the first member 102 attached thereto, may be hoisted above the first level 405 and lowered through the opening of the second rotary station 404. The first member 102 and the second member 104 may then be brought into engagement, so as to provide a weight-transmitting connection, e.g., while substantially avoiding a torque transmission to the second tubular 101B from the first tubular 101A. The tubular-gripping device of the cart 409, supporting the weight of the second tubular 101B, may then be released, such that the weight of the second tubular 101B may be supported by the hoisting equipment coupled with the first tubular 101A, via the lifting coupling 100.

Figure 11:
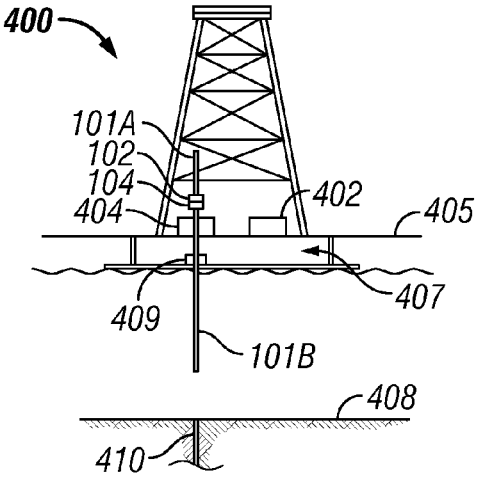

Next, the method 300 may proceed to lifting the first tubular 101A, the lifting coupling 100, and at least a portion of the second tubular 101B through the opening of the second rotary station 404, as at 316. This stage is illustrated, according to an embodiment, in FIG. 11. A bushing may be secured in place in the opening of the second rotary station 404, and the second tubular 101B may be landed on the bushing, such that the rotary station 404, via the bushing, supports the weight of the second tubular 101B.

The method 300 may then include disconnecting the first member 102 from the second member 104, as at 318. In an embodiment, the first member 102 may be supported by casing handling equipment via the first tubular 101A, and thus disconnecting at 318 may be effected by moving the first tubular 101A, with the first member 102 attached thereto, away from the second member 104 and the second tubular 101B, and, e.g., to a rack stand. In addition, the method 300 may include disconnecting the second member 104 from the second tubular 101B, e.g., using an iron roughneck or another suitable torque-applying device. The second tubular 101B may then be handled by any suitable casing-running equipment and be deployed through the second rotary station 404 and into the wellbore 410.

At any point during the method 300, e.g., when the first and second tubulars 101A, 101B are disconnected, the first tubular 101A may be racked back in a rack stand. In some embodiments, the first tubular 101A may be racked back with the first member 102 attached thereto.

While the present teachings have been illustrated with respect to one or more implementations, alterations and/or modifications may be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. A method for running a tubular into a wellbore, comprising:

attaching a first member of a lifting coupling to a first tubular;

attaching a second member of the lifting coupling to a second tubular, wherein the second tubular extends downward through an opening of a rotary station;

connecting together the first and second members of the lifting coupling, such that a weight of the second tubular is transmitted via the lifting coupling to the first tubular;

lowering the lifting coupling, the second tubular, and at least a portion of the first tubular through the opening;

disconnecting the second member from the first member, after lowering the lifting coupling, the second tubular, and the at least a portion of the first tubular; and moving the second member of the lifting coupling and the second tubular laterally, away from the opening.

2. The method of claim 1, wherein disconnecting the first member from the second member comprises substantially avoiding a transmission of a torque from the lifting coupling onto the second tubular.

3. The method of claim 2, wherein disconnecting the first member from the second member comprises rotating at least one of the first member and the second member relative to the other.

4. The method of claim 1, wherein moving the second member and the second tubular comprises moving the second member and the second tubular below an opening in a second rotary station.

5. The method of claim 4, further comprising:

connecting together the first and second members after positioning the second tubular below the second rotary station; and lifting the lifting coupling, the first tubular, and at least a portion of the second tubular at least partially through the opening of the second rotary station.

6. The method of claim 5, further comprising lowering the first member and at least a portion of the first tubular through the opening of the second rotary station, prior to connecting together the first and second members after moving the second tubular below the second rotary station.

7. The method of claim 5, further comprising after lifting the lifting coupling, at least a portion of the first tubular, and at least a portion of the second tubular through the opening of the second rotary station, disconnecting the first and second members, while substantially avoiding a transmission of a torque from the first tubular to the second tubular.

8. The method of claim 5, further comprising disconnecting the second member from the second tubular after lifting the lifting coupling and the first tubular through the opening of the second rotary station.

9. The method of claim 8, further comprising connecting the first member of the lifting coupling to the first tubular, prior to lowering the lifting coupling and the first tubular through the opening of the second rotary station.

10. The method of claim 9, further comprising racking the first tubular in a rack stand with the first member connected thereto.

11. A drilling system, comprising:

a first level comprising a rotary station, wherein the rotary station is configured to run a tubular string into a wellbore;

a second level that is vertically below the first level, wherein the second level comprises a cart configured to support a tubular string and move between a first position located below the rotary station and a second position that is not located below the rotary station; and a lifting coupling comprising:

a first member configured to be connected with a first tubular; and a second member configured to be connected with a second tubular;

wherein the lifting coupling, at least a portion of the first tubular, and at least a portion of the second tubular are configured to be lowered through the rotary station with the first and second members coupled together, wherein the first and second members are configured to be disconnected from one another after being lowered, and wherein the second member and the second tubular are configured to be moved from the first position to the second position after being disconnected.

12. The system of claim 11, wherein the rotary station is a primary rotary station, the system further comprising an auxiliary rotary station having an opening, wherein the auxiliary rotary station is not configured to run a tubular string into the wellbore.

13. The system of claim 11, wherein the first member comprises a plurality of engaging features, and the second member comprises a plurality of engaging features that are configured to engage the plurality of engaging features of the first member such that the first member and the second member are configured to be coupled together and decoupled from one another substantially without transmitting a torque between the first and second tubulars, wherein the plurality of engaging features of the first member comprise a plurality of hooks and a plurality of slots, wherein the plurality of engaging features of the second member comprise a plurality of lugs receivable into the plurality of slots and engageable with the plurality of hooks, and wherein the first member is at least partially receivable into the second member.

14. The system of claim 11, wherein the first tubular comprises at least a portion of a landing string, a drill pipe, or both, and wherein the second tubular comprises at least a portion of a different landing string, a casing, or both.

15. An apparatus for a drilling process, comprising:

a first member configured to be coupled with a first tubular, the first member comprising an engaging portion and a plurality of hooks defined at the engaging portion; and a second member configured to be coupled with a second tubular, the second member comprising a receiving portion defining a receiving cavity and including a plurality of lugs that extend into the receiving cavity, wherein the receiving cavity is sized to at least partially receive the engaging portion of the first member, and the plurality of lugs are configured to engage the plurality of hooks, such that the second member is able to transmit a weight of the second tubular to the first member via the plurality of hooks, wherein the apparatus, at least a portion of the first tubular, and at least a portion of the second tubular are configured to be lowered through a rotary station with the first and second members coupled together, wherein the first and second members are configured to be disconnected from one another after being lowered, and wherein the second member and the second tubular are configured to be moved laterally away from the rotary station after being disconnected.

16. The apparatus of claim 15, wherein the first tubular comprises a drill pipe and the second tubular comprises a casing string, the casing string extending downward from a drilling rig.

17. The apparatus of claim 15, wherein the plurality of hooks are separated circumferentially apart around the engaging portion of the first member by a plurality of J-slots, the plurality of J-slots being configured to receive the plurality of lugs of the second member.

18. The apparatus of claim 15, wherein the first member further comprises a stabbing guide portion extending from the engaging portion and having a diameter that reduces as proceeding away from the engaging portion.

19. The apparatus of claim 18, wherein the second member comprises a frustoconical stabbing guide extending radially outward and axially from the receiving portion.

20. The apparatus of claim 15, wherein at least one of the plurality of hooks comprises an axially-extending wall, a circumferentially-extending wall extending from an end of the axially-extending wall, and a lip wall extending from an end of the circumferentially-extending wall, and wherein the axially-extending wall, the circumferentially-extending wall, and the lip wall define a pocket for receiving at least one of the plurality of lugs.

21. The apparatus of claim 20, wherein the at least one of the plurality of hooks is configured to bear at least a portion of the weight of the second tubular by engagement between at least one of the plurality of lugs and the circumferentially-extending wall of the at least one of the plurality of hooks, when the at least one of the plurality of lugs is positioned in the pocket of the at least one of the plurality of hooks.

22. The apparatus of claim 15, wherein the first member comprises a first extension tubular between the first tubular and the engaging portion, and wherein the second member comprises a second extension tubular between the second tubular and the receiving portion.

* * * * *